United States Patent [19]

Collie et al.

[11] 4,089,478

[45] May 16, 1978

[54] SEED MILL

[75] Inventors: Arthur Alexander Collie, Hayling Island; Barry Graham Charles, Rowlands Castle; Edward Charles Barnett, Hayling Island; Jack Ramshaw, Emsworth, all of England

[73] Assignee: Kenwood Manufacturing Company Limited, England

[21] Appl. No.: 762,622

[22] Filed: Jan. 26, 1977

[51] Int. Cl.[2] ..... B02C 9/02

[52] U.S. Cl. ..... 241/167; 241/230; 241/235; 241/285 B

[58] Field of Search ..... 241/167, 227, 230, 232–235, 241/285 A, 285 B

[56] References Cited

U.S. PATENT DOCUMENTS

| | | | |
|---|---|---|---|
| 202,696 | 4/1878 | Borgfeldt | 241/167 |
| 286,973 | 10/1883 | Titus | 241/230 |
| 1,722,999 | 8/1929 | Andrews et al. | 241/235 |
| 2,327,679 | 8/1943 | Swenson | 241/167 X |
| 2,671,616 | 3/1954 | Fielden | 241/233 |
| 2,738,135 | 3/1956 | Cecka | 241/230 |
| 2,969,193 | 1/1961 | Ball | 241/227 |
| 2,991,019 | 7/1961 | Sugden | 241/167 X |

FOREIGN PATENT DOCUMENTS

| | | | |
|---|---|---|---|
| 185,680 | 8/1966 | U.S.S.R. | 241/227 |

*Primary Examiner*—Roy Lake
*Assistant Examiner*—Howard N. Goldberg
*Attorney, Agent, or Firm*—Craig & Antonelli

[57] ABSTRACT

A seed mill is described, particularly suitable for grinding wheat to produce flour for home-made bread, in which two rollers are rotatable with respect to one another in an open topped housing which is formed in two parts. The rollers are horizontally and vertically offset with respect to one another. An adjustment screw is provided to pivot the two housing parts towards and away from one another whereby a fine adjustment of the spacing between the rollers can be achieved.

19 Claims, 4 Drawing Figures

SEED MILL

The present invention relates to domestic seed mills.

Although the mill of the present invention is primarily intended for grinding wheat to form flour, it could equally be used for grinding other forms of seed.

In recent years it has become increasingly popular for the housewife to make her own bread at home. Packaged flour which is readily available for making cakes and for other normal cooking purposes is not generally very suitable for making bread, because it incorporates an inhibitor to prevent the flour in the package from deteriorating. This inhibitor has a deleterious effect when the flour is used for bread-making since the bread will not rise properly. It is therefore advantageous to grind the flour within, say, two days of making the bread.

Conventional mills as used by the large manufacturers are extremely large and complicated pieces of apparatus having several pairs of milling or grinding rollers to achieve the desired effect. It would not be a practical possibility simply to scale down such commercial mills for use in the kitchen. Certain forms of attachments for domestic mixers have been proposed but these all suffer the disadvantage that their output is low. One of the problems with grinding wheat is that if the flour becomes too hot during the grinding operation the wheat is damaged and will be unsuitable for bread making.

It is an object of the present invention to provide a domestic seed mill which overcome the prior disadvantages.

According to the present invention we provide a domestic seed mill comprising a housing, having an open top, two rollers mounted in said housing about substantially horizontal axes offset from one another, both horizontally and vertically, the peripheral surfaces of the rollers being provided with a plurality of helical teeth, means to drive the rollers in opposite rotational senses, so that the seed fed into the nip between the rollers is passed downwardly therebetween and means to adjust accurately the spacing between the rollers.

It has been found that with such a construction a relatively high rate of operation can be achieved and the wheat grain can be ground in a very satisfactory manner. In a preferred construction there are two rollers and two rollers only. The construction of the present invention can be made relatively small and can either be provided with its own motor, or, preferably, is provided with a drive shaft which is attachable to an auxiliary drive take-off point of a domestic food mixer.

Preferably, in order to ensure there is no wear, and in order to ensure the correct milling or grinding of the grain, a stop is provided to prevent the rollers from touching one another. The housing is advantageously formed in two parts, one roller being mounted on one part and the other roller on the other part, the two parts being pivotally mounted with respect to one another, the adjustment means causing relative pivoting of the two parts. If the pivot is provided at the upper portion of said parts, then any flour which may engage between the two parts will tend to fall out. Preferably the sides of the housing, transverse to the pivot axis, have interengaging rebates.

In the above construction, having two parts, the adjustment means may include a threaded hole on one of the parts and a shaft threaded at one end and passing through and abutting the other part and engaging the threaded hole, and may have an adjustment knob on shaft.

Preferably, the one part has a nut which is located in a socket therein, the nut providing the threaded hole, a shaft being splined at the other end opposite the threaded end, and the adjustment knob being provided with co-operating splines. This arrangement of the nut and splines makes the fitting of the knob onto the shaft much easier, so that the knob can be arranged correctly with respect to a scale on the housing adjacent thereto.

The lower of the two rollers is preferably caused to rotate more slowly than the upper, by means of a larger pinion on the shaft of one roller engaging a smaller pinion on the shaft of the other roller. The rollers are advantageously each threaded onto the shaft with a thread of one hand and the smaller pinion is also threaded onto its shaft with the thread of opposite hand. Such an arrangement enables a robust structure to be made without the need for any keys or cross-pins, which are difficult to apply on small pinions.

The shafts are desirably mounted in the respective housing parts in needle bearings and felt pads surround each shaft on the inner side of the needle bearings, to prevent flour passing into the bearings.

The helix of the teeth of the rollers preferably makes an angle of between 10° and 20° to the axis of the respective shafts and particularly good results have been found with an angle of 15° to the axis of the shaft. Advantageously the teeth are formed by grooves in the rollers, and the grooves having the cross-section of a right-angled triangle, with the right-angle at the surface of the roll and the apex (which is nearer the axis of the roll), being radiused.

In order to ensure that the flour does not stick to the rollers, scrapers may be provided on each roller. The scrapers may be in the form of arcuate tongues which envelope part of the shape of the associated roller, these tongues being cantilevered out from the associated housing part into engagement with the roller.

In order to urge seed into the nip between the rollers a wall may br provided to overlie the laterally outer portion of the upper surfaces of the rollers.

The bottom of the housing of the mill according to the invention is preferably open and a chute may be provided to deflect ground seed, e.g. flour, laterally of the housing, the chute being movable from one position to another to change the direction of lateral flow. If it is desired to make wholemeal bread with the ground flour, then the arrangement could be such that, if the mill is used as an attachment to a conventional domestic foodmixer, the ground flour is deflected sideways into a suitable container. If "white" bread is required, then preferably the bran is separated from the remainder of the flour; this can be effected by placing the deflector in the other sense, so that the flour and bran are discharged into the main mixing bowl of the mixer, this being provided with a sieve or colander and a scraper which passes over the surface of the sieve or colander, so that the flour is caused to pass through the apertures therein, while the bran remains on the surface.

In order that the present invention may more readily be understood, the following description is given, merely by way of example, reference being made to the accompanying drawings, in which.

Figure 1:
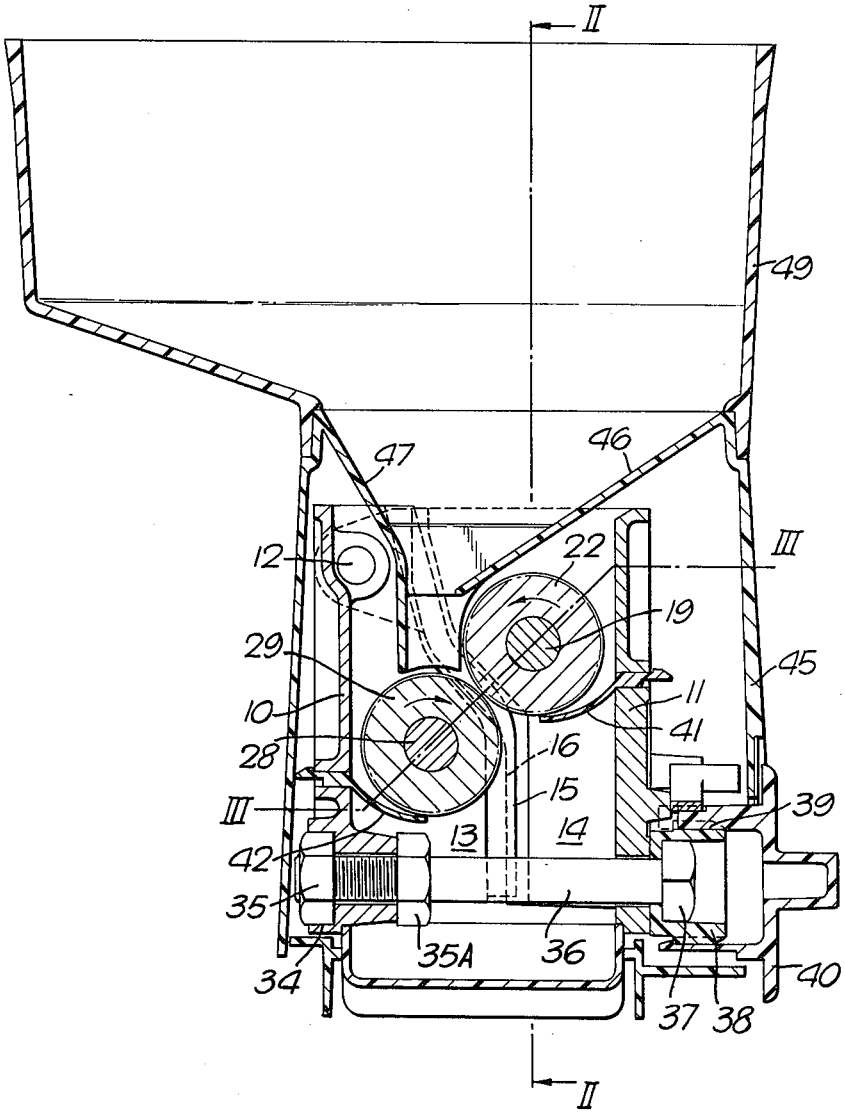
FIG. 1 is a cross-section through one embodiment of seed mill according to the invention.

Referring now to FIG. 1 the mill illustrated includes a housing having a first part 10 and a second part 11 pivotally connected thereto by a shaft 12 which is arranged adjacent the upper end of the two housing parts. As can be seen in FIG. 1, the transverse side 13 and 14 of the housing parts 10 and 11 overlap one another with interengaging rebates 15 and 16.

Mounted in needle bearings 17 and 18 (FIG. 2) in the housing part 11 is a shaft 19 which carries a dog 20 for engagement in the auxiliary drive take-off point of a domestic mixer. The shaft 19 is surrounded by a bearing tube 21 which co-operates with an element on the domestic mixer to hold the attachment in place on the mixer.

Mounted on the shaft 19 is an upper roller 22 this being threaded onto the shaft 19 by left-hand thread 23. Beyond the bearing 18 a small pinion 24 is threaded onto the end of the shaft by a right-hand thread 25.

Further needle bearings 26 and 27 in the housing part 10 support a shaft 28, which is parallel to shaft 19. A roller 29, which is smaller to roller 22, is threaded onto the shaft 28 at 30.

At its end adjacent bearings 27, the shaft 28 carries a pinion 31, which is larger and has more teeth than pinion 24, pinion 31 being held onto the shaft by a pin 32.

In order to ensure that no flour or other dirt enters into the needle bearings felt pads 33 are provided surrounding each shaft on the inner side of the needle bearings.

As can be seen most clearly from FIG. 1, the housing part 10 is provided with a hexagonal socket 34 in which is engaged a nut 35. Threaded into the nut is an adjustment shaft 36 having at its right-hand end a hexagonal head 37 which engages in a control member 38 which is provided, on its outer periphery, with splines 39. An adjustment knob 40 has co-operating splines. It will be appreciated that rotation of the adjustment knob causes rotation of the shaft 36 and thereby pivoting of the housing parts 10 and 11 with respect to one another. The positioning of the pivot 12 with respect to the shafts 19 and 28 of the two rollers 22 and 29 is such that operation of the adjustment shaft sets the maximum spacing of the surface of rollers 22 and 29 closer as the flour passes therebetween. As can be seen from FIG. 1 the axis of shaft 12 is approximately at a point perpendicular to the portion of the sectional line III—III through the axes of the two rollers. A nut 35A prevents the rollers touching.

Below and extending around a portion of the periphery of eacb of the two rollers 22 and 29 are two scrapers 41 and 42, preferably formed of a plastics material such as polypropylene, these being cantilevered out from the respective housing parts and function to scrape material off the surface of the rolls.

The assembly of the two housing parts 10 and 11 and the associated parts mounted therein, is surrounded by a casing 45 which has at its upper end two inclined integrally formed walls 46 and 47, which are intended to feed material into the nip between the two rollers 22 and 29. A central partition 48 (FIG. 2) is provided to prevent accidental insertion of the finger of the user into the nip between the two rollers.

Figure 2:
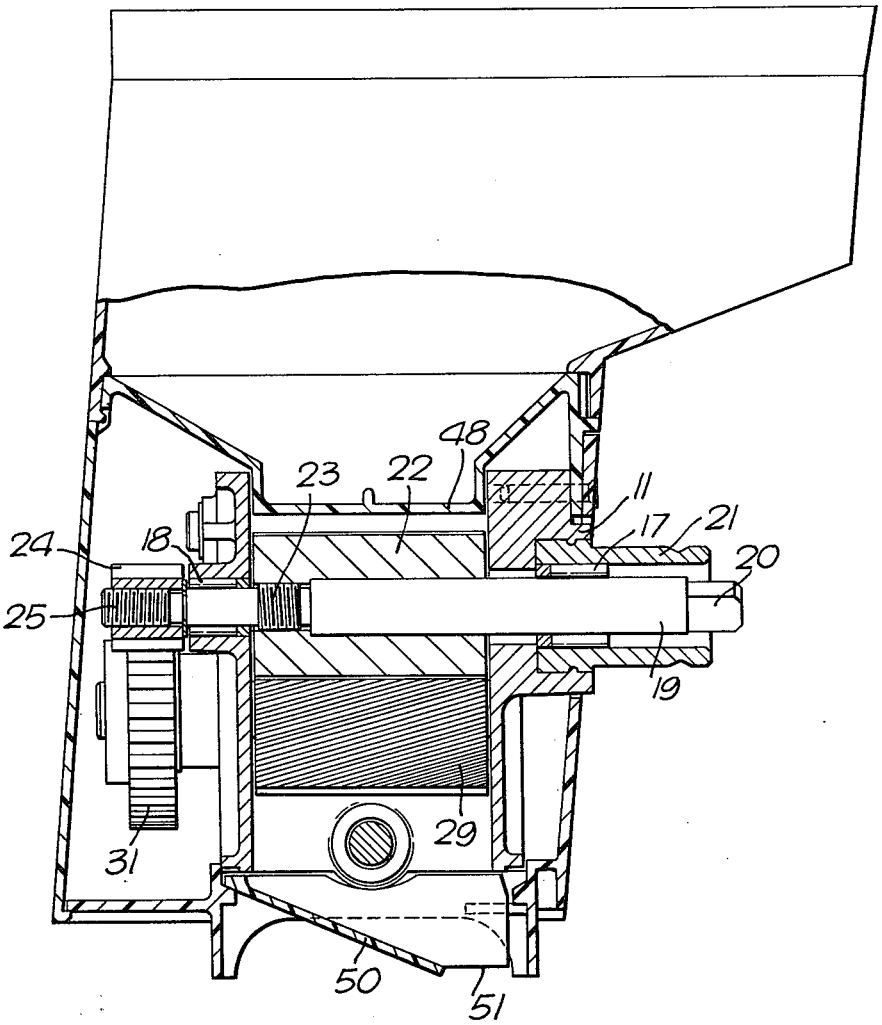
FIG. 2 is a section taken along the line II—II of FIG. 1.
Figure 3:
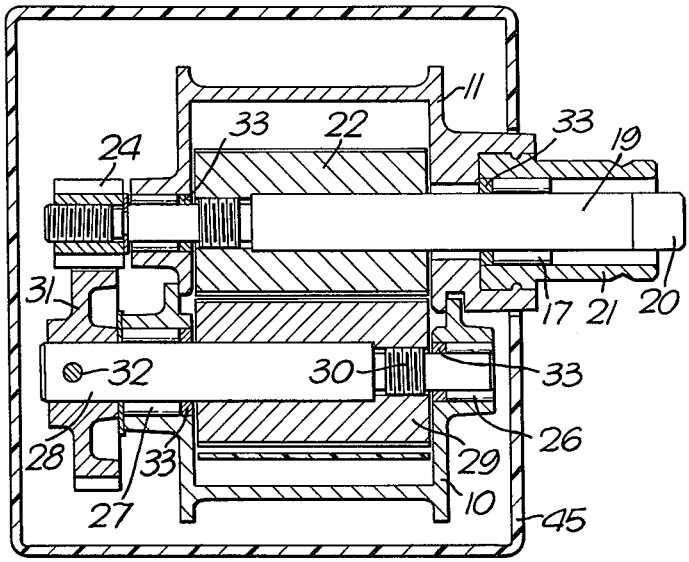
FIG. 3 is a section taken along the line III—III of FIG. 1.

Mounted on top of the casing 45 is a feed hopper 49 and mounted on the bottom of the casing is a discharge chute 50 which can be removed readily and have its position altered by 90°, 180°, or 270° due to the sides being of substantially equal width as can be seen from a comparison of FIGS. 1 and 2, and since, as shown in FIG. 2, the chute 50 is merely supported on flanges within the housing, so that flour or other powdered material leaving the mill can be discharged through the opening 51 in one of a number of different directions.

Figure 4:
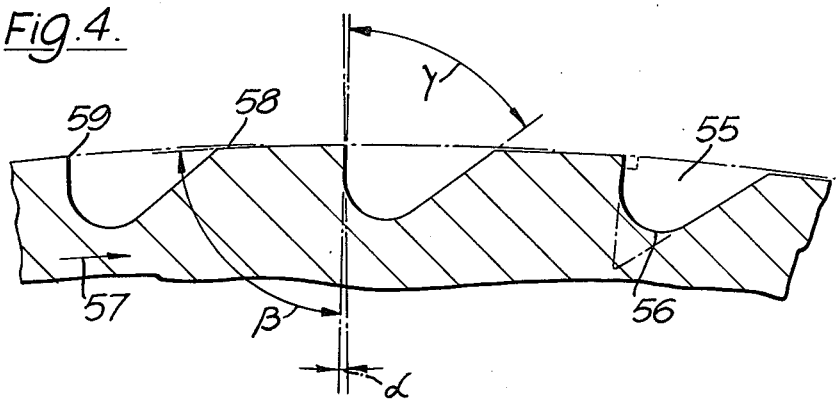
FIG. 4 is an enlarged scrap section through the periphery of one of the rollers of the mill of FIGS. 1, 2 and 3.

As can be seen in FIG. 2, the periphery of the roller 29, and indeed of the roller 22 (although this cannot be seen in FIG. 2) is formed with helical teeth. These helical teeth extend at an angle of between 10° and 20°, preferably 15°, to the axis of the respective shaft. The form of the teeth themselves is shown in FIG. 4. Here it can be seen that the teeth 55 are in the form of grooves which are shaped to have a substantially right angled triangle cross-section, as shown in phantom on the right side of FIG. 4, with the right angle at the surface of the roller, but with the apex of the triangle which is closest to the centre of the roller being provided with a smooth arc 56. The roller is caused to rotate in the direction of the arrow 57 and it can be seen that a slight clearance relief is given at 58, that is at the leading edge; thus in a preferred construction the angle $\alpha$ is between 1° and 3°, the angle $\beta$ between 85° and 86° and the angle $\gamma$ between 51° and 53°. Again in the preferred construction, there are 82 teeth equally spaced around the circumference of the rollers.

When the seed mill illustrated in the drawings is used for grinding wheat, the grain is inserted into the hopper 49 and is guided by the walls 46 and 47 into the nip between the roller 22 and 29. The roller 22 is caused to rotate at a higher speed than the roller 29 by the gears 24 and 31. The shape of the teeth of the two rollers is such that the sharp corner 59 (FIG. 4) chips away at the grain and the resulting flour is collected in the fairly deep groove form of teeth 55 until the roller has moved away from the other roller. The scrapers 41 and 42 scrape the material out of these grooves and it falls downwardly onto the chute 50 from which it is discharged. If one wishes to have wholemeal bread, then the chute will be arranged to guide the flour into a separate receptacle. If one wishes to have "white" bread then it will be discharged into the mixing bowl of the mixer to which the mill is attached, the bowl having fitted thereinto a conventional colander or sieve, and the beater socket of the mixer will have a scraper, e.g. a polypropylene scraper, which tend to force the flour through the holes of the colander or sieve while enabling the bran to remain on the top of the sieve to be thrown away.

By having an accurate adjustment, as illustrated, the spacing between the rollers can be made to exactly the right value. Without such a control, one tends to get overheating of the flour which can be damaging to the flour or alternatively, one will get a bad grinding effect. The particular shape of the teeth and the helix angle has also been found to be advantageous.

It will be appreciated that construction of the present invention is compact and relatively inexpensive so that it can easily be mounted on a conventional domestic mixer. The mill could, of course, be provided with its own motor and used as a separate piece of equipment.

By providing the pivot 12 at the top, and the rebates 15 and 16, the flour which is milled is retained within the housing, and yet any flour which tends to get between the two parts can drop out without causing jamming.

We claim:

1. A domestic seed mill comprising, in combination:
a. a housing having an open top;
b. two rollers mounted in said housing about substantially horizontal axes offset from one another both horizontally and vertically;
c. peripheral surfaces of the rollers formed with a plurality of helical teeth formed as grooves in the rollers, the grooves having the cross-section of a right-angled triangle, with the right-angle at the surface of the roller, two straight sides of the triangle being recessed below said peripheral surfaces of the rollers and defining said grooves, the apex of the triangle being formed at the intersection of said two straight sides and made arcuate,
d. means to drive the rollers in opposite rotational senses, whereby seed fed into the lip between the rollers is passed downwardly therebetween.

2. A mill as claimed in claim 1, and further comprising a stop effective to prevent the rollers from touching one another.

3. A seed mill according to claim 1, wherein said mill further comprises means to adjust accurately the spacing between the said rollers and retain said rollers in the adjusted space during milling.

4. A mill as claimed in claim 3, wherein the housing is formed of two parts, and further comprising a pivotal connection between the two parts, wherein one roller is mounted on one part and the other roller is mounted on the other part, and the adjustment means causes relative pivoting of the two parts and determines the maximum spacing between said rollers.

5. A mill as claimed in claim 4, wherein the adjustment means comprises a threaded hole on one of said parts and a shaft threaded at one end and passing through and abutting the other part and engaging the threaded hole and an adjustment knob on said shaft.

6. A mill as claimed in claim 5, and further comprising a nut located in a socket formed in one part of the housing, the nut providing the threaded hole, and splines at the end of the shaft opposite said threaded end, and co-operating splines on said adjustment knob.

7. A mill as claimed in claim 1, wherein there are only two rollers in the mill.

8. A mill as claimed in claim 1, wherein the rollers are each threaded onto a separate shaft with a thread of one hand and further comprising a larger pinion on one shaft and a smaller pinion on the other shaft, the smaller pinion also being fitted onto its shaft with the thread of the opposite hand, said pinions engaging one another whereby the lower of the two rollers is caused to rotate more slowly than the upper.

9. A mill as claimed in claim 1, wherein the helix of the teeth makes an angle of between 10° and 20° to the axis of the respective roller shaft.

10. A mill as claimed in claim 1, and further comprising scrapers on each of said rollers.

11. A mill as claimed in claim 10, wherein the scrapers are in the form of arcuate tongues which envelope part of the shape of the associated roller, and wherein the scrapers are cantilevered out from the associated housing part into engagement with the roller.

12. A mill as claimed in claim 1, and further comprising an open bottom to the housing, and a chute to deflect ground seed laterally of the housing, said chute being removable from one position to the other to change the direction of lateral flow.

13. A mill as claimed in claim 1, and further comprising two scrapers in the form of arcuate tongues of a curvature corresponding to that of said rollers associated with said two rollers, respectively, and enveloping part of the shape of the associated roller at a location below said roller, and wherein the scrapers are cantilevered out from the associated housing part into engagement with the roller.

14. A mill as claimed in claim 1, wherein said drive means includes coupling means for operatively connecting means to drive the rollers to a drive take-off point of a domestic appliance as an attachment thereto.

15. A domestic seed mill comprising, in combination:
a. a housing having an open top;
b. two rollers mounted in said housing about substantially horizontal axes offset from one another both horizontally and vertically;
c. peripheral surfaces of the rollers formed with a plurality of helical teeth formed as grooves in the rollers, and
d. means to drive the rollers in opposite rotational senses, whereby seed fed into the nip between the rollers is passed downwardly therebetween, wherein said mill further comprises means to adjust accurately the spacing between the said rollers and retain said rollers in the adjusted space during milling, wherein the housing is formed of two parts, and further comprising a pivotal connection between the two parts, wherein one roller is mounted on one part and the other roller is mounted on the other part, and the adjustment means causes relative pivoting of the two parts and determines the maximum spacing between said rollers.

16. A mill as claimed in claim 15, wherein the adjustment means comprises a threaded hole on one of said parts and a shaft threaded at one end and passing through and abutting the other part and engaging the threaded hole and an adjustment knob on said shaft.

17. A mill as claimed in claim 16, and further comprising a nut located in a socket formed in one part of the housing, the nut providing the threaded hole, and splines at the end of the shaft opposite said threaded end, and co-operating splines on said adjustment knob.

18. A mill as claimed in claim 15, wherein the pivot is at the upper portion of said parts.

19. A mill as claimed in claim 15, wherein the sides of the housing transverse to the pivot axis have interengaging rebates.

* * * * *